US007073526B2

(12) United States Patent
Nguyen

(10) Patent No.: US 7,073,526 B2
(45) Date of Patent: Jul. 11, 2006

(54) CONNECTING AN ELECTRICAL CUT-OFF SWITCH IN A GAS APPLIANCE

(75) Inventor: Can Trong Nguyen, Garden Grove, CA (US)

(73) Assignee: Robertshaw Controls Company, Richmond, VA (US)

( * ) Notice: Subject to any disclaimer, the term of this patent is extended or adjusted under 35 U.S.C. 154(b) by 273 days.

(21) Appl. No.: 10/813,477

(22) Filed: Mar. 30, 2004

(65) Prior Publication Data

US 2005/0221244 A1 Oct. 6, 2005

(51) Int. Cl.
*F23N 5/10* (2006.01)

(52) U.S. Cl. ..... 137/66; 439/320

(58) Field of Classification Search ..... 137/66; 439/320, 312

See application file for complete search history.

(56) References Cited

U.S. PATENT DOCUMENTS 2,296,322 A * 9/1942 Alfery ..... 137/66
3,286,216 A 11/1966 Jackson et al.
3,286,923 A 11/1966 Jackson et al.
3,810,054 A 5/1974 Nelson
5,967,766 A * 10/1999 Katchka ..... 137/66
6,182,944 B1 2/2001 Veronese et al.
2003/0030024 A1 2/2003 Bushik et al.

* cited by examiner

*Primary Examiner*—Kevin Lee
(74) *Attorney, Agent, or Firm*—Reinhart Boerner Van Deuren

(57) ABSTRACT

A gas control valve is provided for a gas appliance that includes an electrical cut-off (ECO) switch, and a thermocouple having an electrical terminal. The gas control valve includes a control valve housing having a bore therein, an automatic pilot valve magnet disposed the bore and having an electrical terminal, and a connector apparatus for connecting the ECO switch in a series circuit relationship between the electrical terminals of the thermocouple and the pilot valve magnet. The connector apparatus includes a spacer abutting the pilot valve magnet in the bore, a connector for engaging the spacer through a window in the control valve housing and connecting the ECO switch to electrical terminals of the thermocouple and pilot valve magnet, and a retainer for clamping the spacer against the pilot valve magnet and receiving the thermocouple.

24 Claims, 6 Drawing Sheets

CONNECTING AN ELECTRICAL CUT-OFF SWITCH IN A GAS APPLIANCE

FIELD OF THE INVENTION

This invention pertains to gas-fired heating appliances, and more particularly to connecting an electrical cut-off (ECO) switch of such gas-fired appliances in a series electrical circuit relationship between an electrical terminal of a thermocouple and an electrical terminal of an automatic pilot valve magnet of a gas control valve of such a gas-fired heating appliance.

BACKGROUND OF THE INVENTION

It has long been the practice in gas-fired heating appliances having a pilot light, such as water heaters, furnaces and clothes driers, (hereinafter collectively referenced as, gas appliances) to utilize a gas control valve that includes a magnetically operated safety valve for shutting off the flow of gas if the pilot light should be extinguished. Such magnetically operated safety valves typically include a device known in the industry as an automatic pilot valve magnet that is connected to a thermocouple exposed to the pilot light flame.

The pilot valve magnet is an electrically operated solenoid valve, having a valve poppet mounted on a movable armature, and an electrical coil that generates a magnetic flux for moving the armature when an electrical current is applied to the electrical coil. The electrical coil is connected to the thermocouple in such a manner that, when the pilot light is heating the thermocouple, and causing it to produce a flow of current through the electrical coil, the valve poppet is held in an open position allowing a flow of gas through the control valve. The pilot valve magnet also includes a spring for biasing the armature and poppet toward a closed position of the valve, so that if the pilot light is extinguished, thereby causing the thermocouple to stop providing and electrical current to the electrical coil of the pilot valve magnet, the spring will move the armature and poppet to the closed position of the valve, to thereby cut off the flow of gas through the gas control valve. A mechanism is also typically provided in the gas valve for mechanically opening and holding the poppet in an open position while the pilot light is being lit, and for a minute or so after lighting, while the pilot light flame is heating the thermocouple to a high enough temperature that the current it is producing will hold the valve poppet open.

It has also been the practice in some gas appliances to provide an electrical cut-off (ECO) switch, connected in a series electrical circuit relationship between the thermocouple and the automatic pilot valve magnet, for interrupting the flow of current from the thermocouple to the pilot valve magnet when the ECO switch is open, regardless of whether the pilot valve is burning or not. Such ECO switches are often actuated by bi-metallic elements that open the ECO switch in the event that an over-temperature condition occurs in the gas appliance. In a water heater, for example an ECO switch is often used for cutting off flow of gas through the gas control valve, if the temperature of water in the water heater rises above a predetermined maximum temperature.

FIGS. 1 and 2 illustrate the manner in which the series electrical connection of the ECO switch between the thermocouple and pilot valve magnet has typically been accomplished in the past, in a manner that is also generally described in U.S. Pat. Nos. 3,286,216 and 3,286,923, to Jackson, et al.

FIG. 1 shows a prior control apparatus 110, configured for installation into a bore 112 of a valve housing 114 of a gas control valve 100 for a gas appliance (not shown) having an electrical cut-off (ECO) switch (not shown). The prior control apparatus 110 includes an automatic pilot valve magnet 116, an ECO connector 118, and a crimp-on retainer 120.

The pilot valve magnet 116 includes an externally threaded portion 122 thereof for engaging mating threads 124 in the bore 112 of the valve housing 114. The interior end (not shown) of the bore 112 includes a valve seat (not shown) that is closed when a poppet 126 attached to the armature 128 of the pilot valve magnet 116 is moved to an extended position by a biasing spring 130 of the pilot valve magnet 116.

An exposed end 131 of the pilot valve magnet 116 extends outward from the valve housing 114, when the control apparatus 110 is installed in the bore 112, and includes a threaded central bore 132 for receiving a threaded coupling 134 of a thermocouple 136. A transversely extending slot 138, opening axially outward from the exposed end 131 of the pilot valve magnet 116, extends diametrically across the exposed end 131 end of the pilot valve magnet 116, for receipt therein of the ECO connector 118. The ECO connector is installed into the transversely extending slot 138 prior to installation of the control apparatus 110 into the bore 112, and is clamped in place by the crimp-on retainer 120, which has a lip 140 that is crimped into an annular groove 142 in the exposed end 131 of the pilot valve magnet 116, as shown in FIG. 2.

As shown in FIG. 1, the ECO connector 118 includes a central, cylindrical shaped, annular section 144, having an outer periphery configured to slide into the threaded central bore 132 in the exposed end 131 of the pilot valve magnet 116. The inner periphery of the annular section 144 of the ECO connector 118 defines a blind hole 146 for receiving an electrical terminal 148 of the thermocouple 136.

As shown in FIG. 2, the ECO connector 118 includes a first and a second ECO switch contact 150, 152, electrically isolated form one another by a layer of insulation 151. The layer of insulation 151 may either be part of a housing of the ECO connector, or a separate piece of insulation. The second ECO switch contact 152 mates with the electrical terminal 148 of the thermocouple 136. The first ECO switch contact 150 mates with an electrical terminal 154 of the pilot valve magnet 116 that is located at the bottom of the slot 138 in the exposed end 131 of the pilot valve magnet 116.

Although the control apparatus 110 described above has been used with great success for many years, there are some areas in which improvement is desirable.

For example, having the pilot valve magnet 116 configured to include such features as the externally threaded portion 122, for retaining the control apparatus 110 in the bore 112 of the valve 114, the threaded central bore 132, for receiving the thermocouple 136, the extending slot 138, for receiving the ECO connector 118, and the annular groove 142, for receiving the crimped edge 140 of the crimp-on retainer 120, add considerable complexity and cost to the pilot valve magnet 116. The pilot valve magnet 116 configuration is also typically unique to a particular gas valve 114, thereby precluding the use of a standardized pilot valve magnet that could be used in several gas control valves of differing configuration, to thereby reduce cost by increasing production volumes and reducing inventory.

Having the ECO connector 118 mounted in the slot 138 of the exposed end 131 of the pilot valve magnet 116 also undesirably increases the distance that the exposed end 131 extends from the valve 114. An additional problem is also created by this arrangement, with regard to installation of the pilot valve magnet 116 and routing of wires 156, 158 extending from the first and second ECO switch contacts 150, 152, because, as the pilot valve magnet 116 is threaded into the bore 112 of the control valve 114, the wires 156, 158 rotate with the pilot valve magnet 116, and may not be oriented in an optimal direction for connection to the ECO switch when the pilot valve magnet is tightened to its final position.

What is needed is an improved control apparatus for a gas control valve that solves one or more of the problems described above.

BRIEF SUMMARY OF THE INVENTION

The invention provides an improved gas control apparatus for a gas control valve, solving the problems described above, through the use of an improved connector apparatus for connecting an electrical cut-off (ECO) switch of a gas appliance in a series electrical circuit relationship between an electrical terminal of a thermocouple and an electrical terminal of an automatic pilot valve magnet mounted in a bore of a gas control valve of the gas appliance.

In one form of the invention, the connector apparatus includes a spacer adapted for installation into the bore between the pilot valve magnet and the thermocouple, a connector adapted for engaging the spacer, and a retainer having an external thread on an outer periphery thereof for threadably engaging the bore and clamping the spacer against the pilot valve magnet. The connector includes first and second axially spaced electrical contacts that are electrically insulated from one another, with the first electrical contact being adapted for contacting the electrical terminal of the pilot valve magnet, and the second electrical contact being adapted for contacting the electrical terminal of the thermocouple. The retainer includes an internally threaded, axially oriented, through-hole therein for threadably receiving and retaining the thermocouple therein, with the electrical terminal of the thermocouple in contact with the second electrical contact of the connector.

In another form of the invention, a control apparatus is provided, for installation into a bore of a gas control valve of a gas appliance having an electrical cut-off (ECO) switch and a thermocouple, where the bore of the gas control valve defines a central longitudinally extending axis thereof and the thermocouple includes an electrical terminal thereof. The control apparatus includes an automatic pilot valve magnet that includes a pilot valve magnet electrical terminal at an axial end thereof and is axially insertable into the bore, in combination with a connector apparatus according to the invention.

In yet another form of the invention, a gas control valve is provided for a gas appliance having an electrical cut-off (ECO) switch and a thermocouple, where the thermocouple includes an electrical terminal thereof. The gas control valve includes a control valve housing having a bore therein defining a central longitudinally extending axis of the bore, and an automatic pilot valve magnet that includes a pilot valve electrical terminal at one end thereof and is axially insertable into the bore, in combination with a connector apparatus according to the invention.

According to one aspect of the invention, the bore of the gas control valve defines a generally cylindrical wall thereof having a window extending radially therethrough for passage of the connector, and the connector is adapted for insertion in a radial direction, through the window and into the slot in the spacer, after the pilot valve magnet, spacer, and retainer of the connector apparatus have been installed in the bore of the gas control valve.

According to another aspect of the invention, the window in the bore of the gas control valve defines an edge thereof, and the spacer includes one or more anti-rotation tabs extending radially outward therefrom for engaging the edge of the window, to thereby preclude rotation of the spacer in the bore as the retainer is threaded into contact with the spacer.

Other aspects, objectives and advantages of the invention will become apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents included within the spirit and scope of the invention as defined by the appended claims.

DETAILED DESCRIPTION OF THE INVENTION

Figure 1:
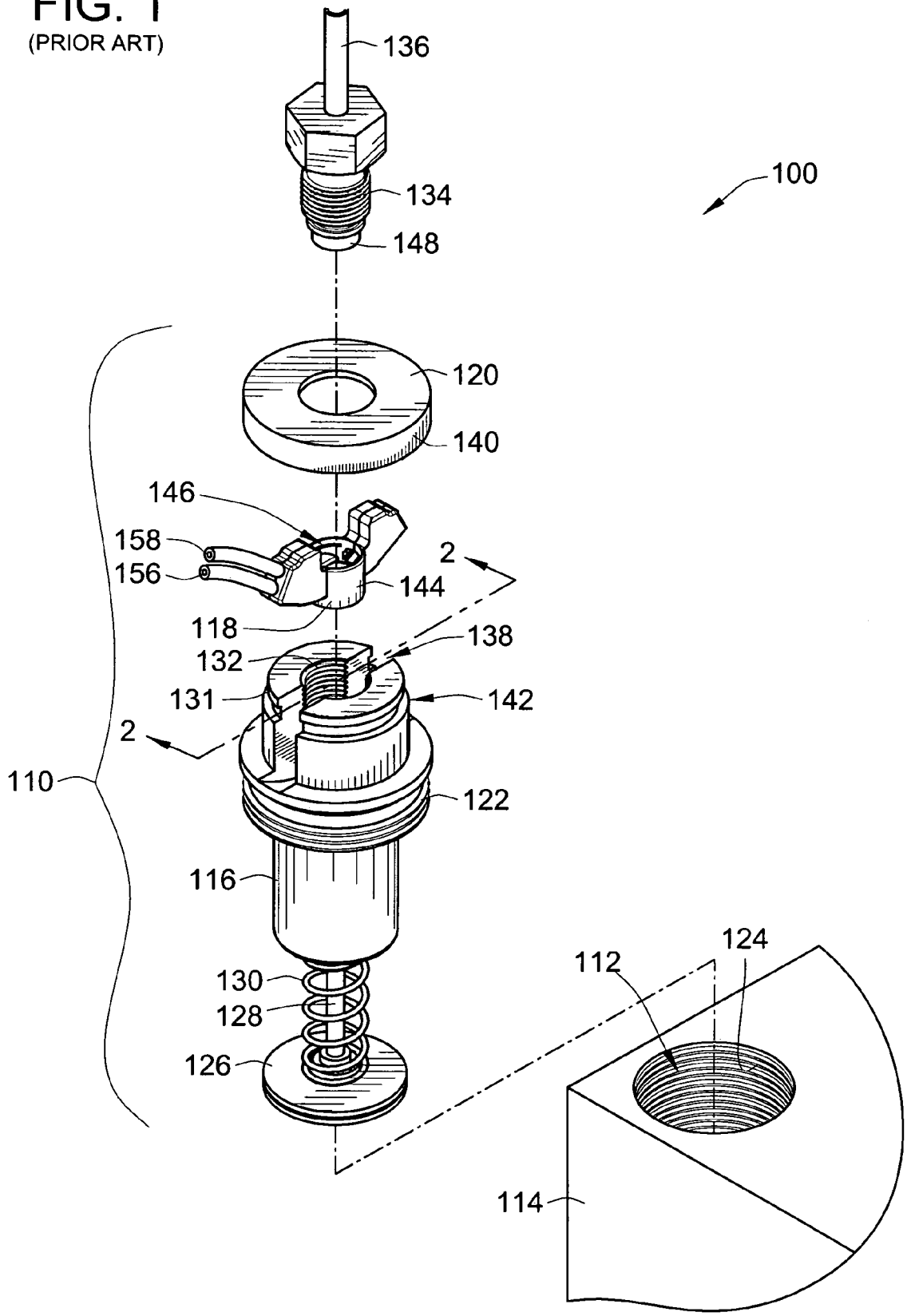
FIG. 1 (PRIOR ART)
FIG. 1 is an exploded perspective view of a portion of a prior gas control valve for a gas appliance having an electrical cut-off (ECO) switch.
Figure 2:
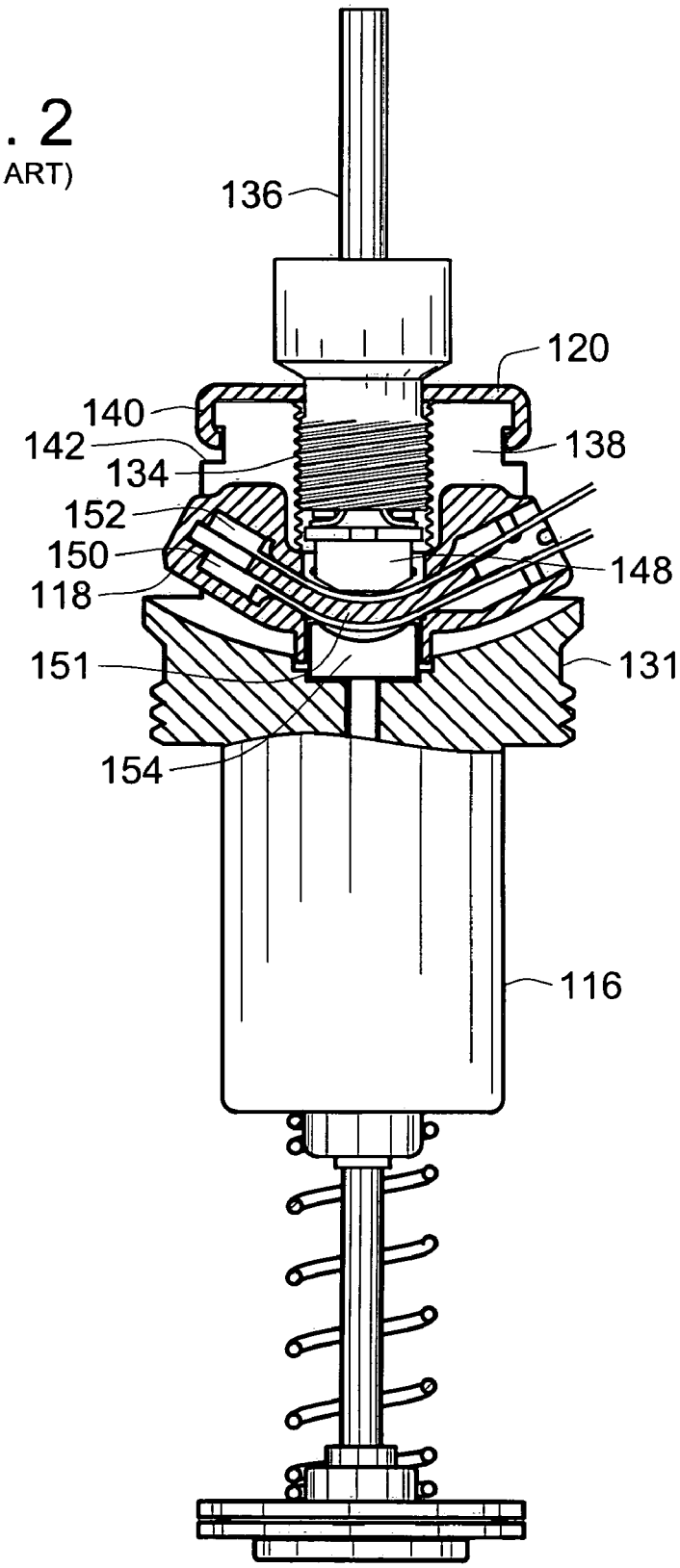
FIG. 2 (PRIOR ART)
FIG. 2 is a perspective, non-exploded, partial section of a portion of the prior gas control valve of FIG. 1, taken generally along a plane indicated by line 2—2, as shown in FIG. 1.
Figure 3:
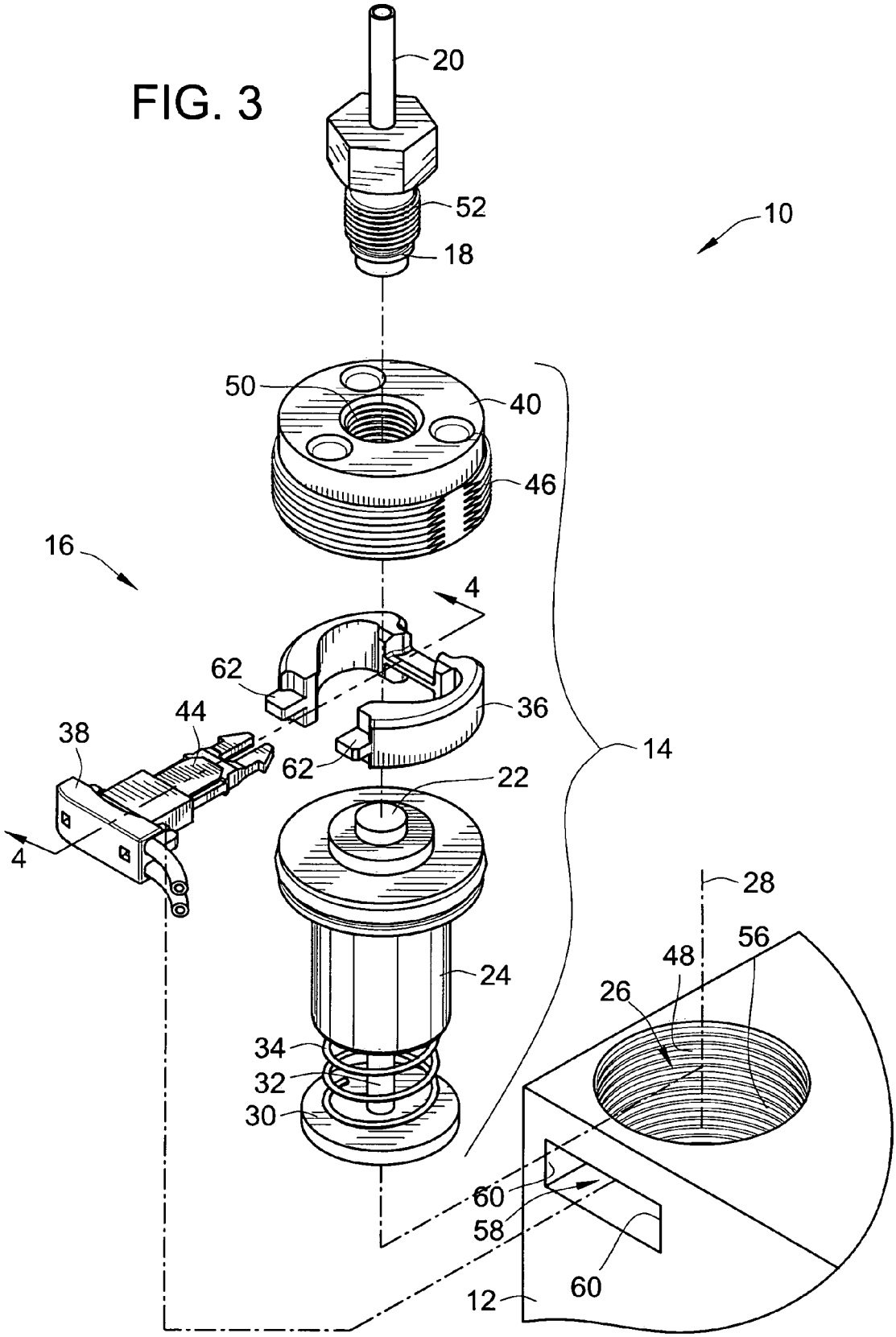
FIG. 3 is an exploded perspective view of a portion of a gas control valve, according to the invention, for a gas appliance having an electrical cut-off (ECO) switch.

FIG. 3 shows an exemplary embodiment of a gas valve 10, according to the invention. The gas valve 10 includes a valve housing 12, a control apparatus 14, and a connector apparatus 16. The connector apparatus 16 connects an electrical cut-off (ECO) switch (not shown) of a gas appliance (not shown) in a series electrical circuit relationship between an electrical terminal 18 of a thermocouple 20 and an electrical terminal 22 of an automatic pilot valve magnet 24, when the pilot valve magnet 24 is mounted in a bore 26 in the valve housing 12.

Figure 4:
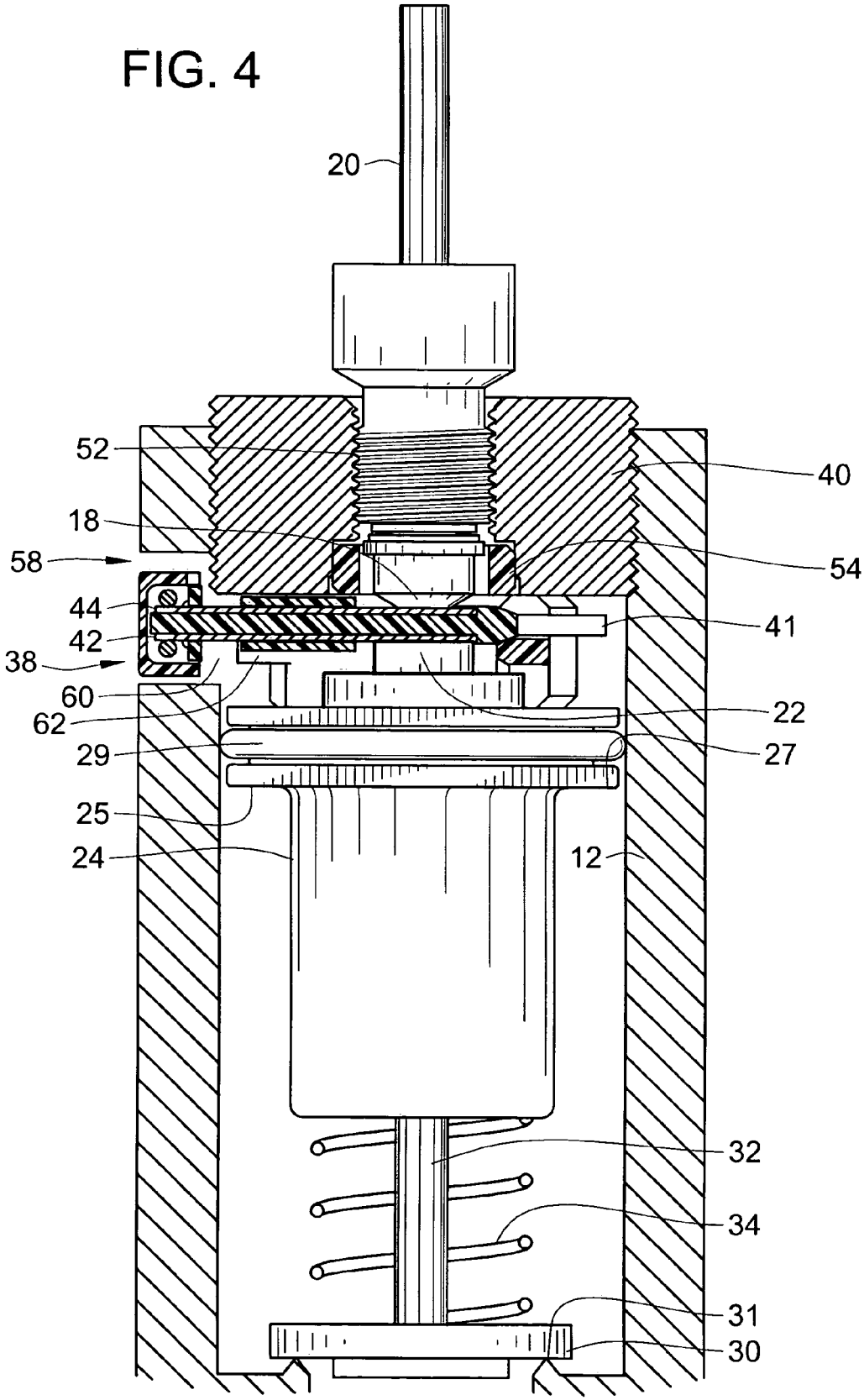
FIG. 4 is a perspective, non-exploded, partial section of a portion of the gas control valve of FIG. 3, taken generally along a plane indicated by line 4—4, as shown in FIG. 3.

As shown in FIGS. 3 and 4, the bore 26 in the valve housing defines a central, longitudinally extending axis 28 thereof, along which the pilot valve magnet 24 is inserted into the valve housing 12, with the electrical terminal 22 of the pilot valve magnet 24 facing (upward as shown) toward the thermocouple 20. The pilot valve magnet 24 includes a radially extending shoulder 25 thereof, which engages a step 27 in the bore 26 of the housing 12, for positioning the pilot valve magnet axially within the bore 26. An O-ring 29 provides a gas-tight seal between the pilot valve magnet 24 and the housing 12. The interior end of the bore 26 includes a valve seat 31 that is closed when a poppet 30, attached to an armature 32 of the pilot valve magnet 24 is moved to an extended position by a biasing spring 34 of the pilot valve magnet 24.

In general, the pilot valve magnet 24 of the present invention is functionally identical to the prior pilot valve magnet 116 described above, but does not include the externally threaded portion 122, for retaining the control apparatus 110 in the bore 112 of the valve 114, the threaded central bore 132, for receiving the thermocouple 136, the extending slot 138, for receiving the ECO connector 118, or the annular groove 142, for receiving the crimped edge 140 of the crimp-on retainer 120, of the prior pilot valve magnet 116. Elimination of these features allows the pilot valve magnet 24 of the present invention to be considerably shorter, and easier to install than the prior pilot valve magnet 116. The pilot valve magnet 24 of the present invention is also simpler and less costly to manufacture, than the prior pilot valve magnet 116, and is usable as a standardized part in a variety of different gas valve applications.

The connector apparatus 16 includes a spacer 36, an ECO connector 38, and a retainer 40.

The spacer 36 is adapted, in a manner described in more detail below, for installation into the bore 26 of the valve body 12, between the pilot valve magnet 24 and the thermocouple 20, and for receiving the connector 38.

The connector 38 is adapted for engaging the spacer 36, in a manner described in more detail below. As shown in FIG. 4, the connector 38 includes a connector housing 41, and first and second axially spaced electrical contacts 42, 44 that are electrically insulated from one another by the connector housing 41. The first electrical contact 42 is adapted for contacting the electrical terminal 22 of the pilot valve magnet 24, and the second electrical contact 44 is adapted for contacting the electrical terminal 18 of the thermocouple 20.

As shown in FIG. 3, The retainer 40 includes an external thread 46 on an outer periphery thereof, for threadably engaging mating threads 48 in the bore 26 of the valve housing 12 and clamping the spacer 36 against the pilot valve magnet 24. The retainer 40 also includes an internally threaded, axially oriented through-hole 50 therein, for threadably receiving and retaining therein a threaded coupling 52 of the thermocouple 20, with the electrical terminal 18 of the thermocouple 20 in contact with the second electrical contact 44 of the connector 38.

As shown in FIG. 4, the retainer 40 further includes a cylindrically shaped annular insert 54 of electrically insulative material disposed in the axially oriented through-hole 50 at one end thereof, for providing a ring of electrical insulation between the electrical contact 18 of the thermocouple 20 and the retainer 40.

As shown in FIG. 3, the bore 26 of the housing 12 of the gas control valve 10 defines a generally cylindrical wall 56 thereof, having a rectangular shaped window 58 extending radially therethrough, for passage of the connector 38. The window 58 also defines an pair of edges 60 thereof, and the spacer 36 includes two anti-rotation tabs 62 extending radially outward therefrom, for engaging the edges 60 of the window 58, to thereby preclude rotation of the spacer 36 in the bore 26 as the retainer 40 is threaded into contact with the spacer 36. During insertion of the spacer 36 into the bore 26, the spacer 36 is tilted at an oblique angle to the axis 28 of the bore 26, with the anti-rotation tabs pointing into the bore 26, so that the anti-rotation tabs 62 will clear the wall 56 of the bore 26. As the spacer 36 is guided down into position within the bore 26, it is tilted back perpendicular to the axis 28, to guide the anti-rotation tabs 62 into engagement with the edges 60 of the window 58.

Figure 5:
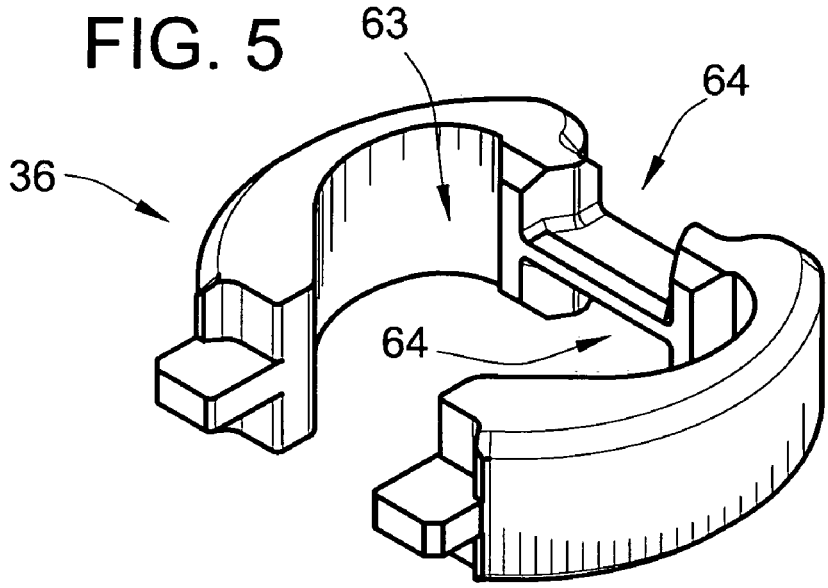
FIG. 5 is a perspective view of a spacer, according to the invention, of the gas control valve of FIGS. 3 and 4.

As shown in FIG. 5, the spacer 36 is generally cylindrically shaped, and has a radially inner surface thereof defining a somewhat heart-shaped hole 63. The spacer 36 also defines a pair of axially spaced, diametrically extending, radially opening slots 64 therein for receiving the connector 36. The slots 64 are positioned at opposite axial ends of the spacer 36, and each open toward a respective axial end of the spacer 36, to thereby allow the spacer 36 to be installed in the bore 26 with either the first or the second axial end thereof facing the retainer 40, and to thereby allow insertion of the connector 38 into a desired one of the first or second radially extending slots 64, regardless of which of the first and second axial ends of the spacer 36 is facing toward the retainer 40.

Figure 6:
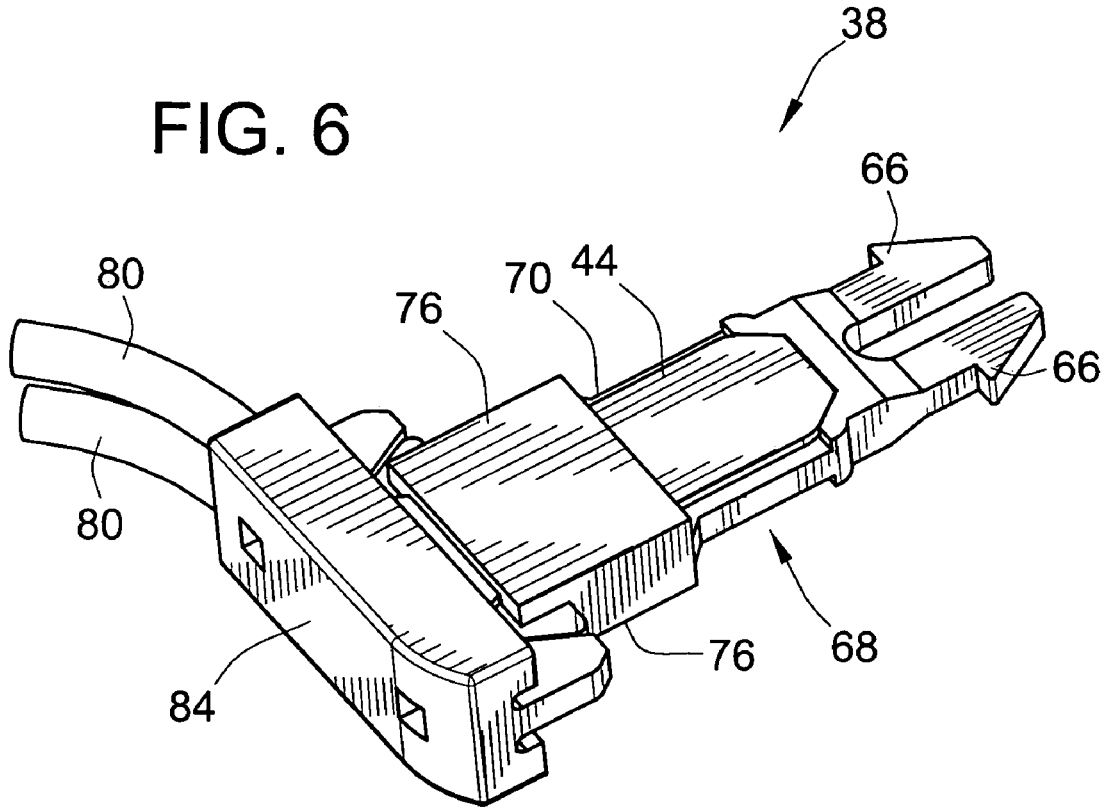
FIG. 6 is a perspective view of a connector, according to the invention, configured for mating engagement with the spacer of FIG. 5.
Figure 7:
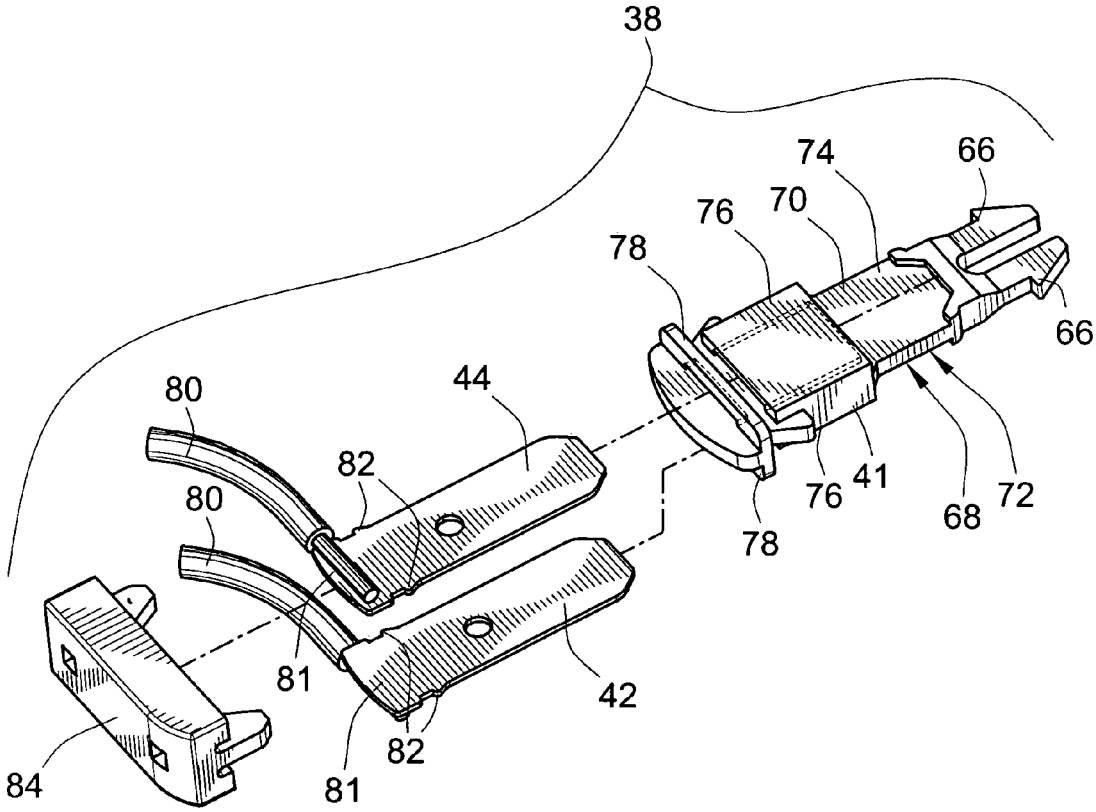
FIG. 7 is an exploded perspective view of the connector of FIG. 6

As shown in FIGS. 6 and 7, the connector 38 includes locking tangs 66 for engaging one of the radially opening slots 64 in the spacer 36 and retaining the connector 38 in the slot 64. The connector housing 41 is generally planar shaped and fabricated from an electrically insulating material. One end of the connector housing 41 is formed to define the locking tangs 66. The connector housing 41 further defines identical and symmetrical first and a second generally planar surfaces 68, 70 thereof, each including identical and symmetrical features, in the form of first and second contact receiving recesses 72, 74 and a pair of contact-retaining bridges 76, 78 disposed adjacent each of the first and second recesses 72, 74. The first and second contact receiving recesses 72, 74, respectively, receive the first and a second ECO switch contacts 42, 44, and the contact-retaining bridges 76, 78 retain the first and second ECO switch contacts 42, 44 in the first and second recesses 72, 74.

The first and a second ECO switch contacts 42, 44 each have a wire 80 attached to a distal end 81 thereof, adjacent an end of the connector housing 41 opposite the locking tangs 66. Because the thermocouple 136 is capable of producing only a very small electrical current, it is important that the wires 80 be attached to the switch contacts 42, 44 in a manner that creates very low electrical resistance. In this regard, it is contemplated that the wires 80 will generally be attached to the switch contacts 42, 44 by a process such as welding, brazing, or crimping. The first and second ECO switch contacts 42, 48 each also include barbs 82 for engaging the connector housing 41 to help retain the first and second ECO switch contacts 42, 44 in the first and second recesses 72, 74 respectively.

The connector 36 also includes a connector cover 84 attached to the connector housing 41 over the distal ends 81 of the first and second ECO switch contacts 42, 44. The connector cover 84 provides electrical insulation of the distal ends of the first and second ECO switch contacts 42, 44, and helps to retain the switch contacts 42, 44 in the connector housing 41. The connector cover 84 may be attached to the connector housing in any appropriate manner, such as snapping on, adhesive bonding, retained with screws or rivets, ultrasonic welding, etc. In the exemplary embodiment shown herein, the connector cover 84 is a snap-on device having locking spring-action lugs, that allow the cover 84 to be snapped onto the connector housing 41, for engaging the connector housing 41 to thereby retain the cover 84 in place on the connector housing 41.

The exemplary embodiments described herein represent preferred embodiments of this invention, including the best mode known to the inventors for carrying out the invention. Variations of these preferred embodiments may become apparent to those of ordinary skill in the art upon reading the foregoing description. The inventors expect skilled artisans to employ such variations as appropriate, and the inventors intend for the invention to be practiced otherwise than as specifically described herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A connector apparatus for connecting an electrical cut-off (ECO) switch of a gas appliance in a series electrical circuit relationship between an electrical terminal of a thermocouple and an electrical terminal of an automatic pilot valve magnet, when the pilot valve magnet is mounted in a bore of a gas control valve, with the bore defining a central longitudinally extending axis thereof, the connector apparatus comprising:

a spacer adapted for installation into the bore between the pilot valve magnet and the thermocouple;

a connector adapted for engaging the spacer, and having first and second axially spaced electrical contacts electrically insulated from one another, the first electrical contact being adapted for contacting the electrical terminal of the pilot valve magnet, and the second electrical contact being adapted for contacting the electrical terminal of the thermocouple; and a retainer having an external thread on an outer periphery thereof for threadably engaging the bore and clamping the spacer against the pilot valve magnet, the retainer also having an internally threaded, axially oriented, through-hole therein for threadably receiving and retaining the thermocouple therein with the electrical terminal of the thermocouple in contact with the second electrical contact of the connector.

2. The connector apparatus of claim 1, wherein the retainer further comprises a cylindrically shaped annular insert of electrically insulative material disposed in the axially oriented through-hole at one end thereof, for providing a ring of electrical insulation between the electrical contact of the thermocouple and the retainer.

3. The connector apparatus of claim 1, wherein:

the bore of the gas control valve defines a generally cylindrical wall thereof having a window extending radially therethrough for passage of the connector; and the connector is adapted for insertion in a radial direction, through the window and into engagement with the spacer.

4. The connector apparatus of claim 1, wherein:

the bore of the gas control valve defines a generally cylindrical wall thereof having a window extending radially therethrough for passage of the connector;

the window defines an edge thereof; and the spacer includes one or more anti-rotation tabs extending radially outward therefrom for engaging the edge of the window, to thereby preclude rotation of the spacer in the bore as the retainer is threaded into contact with the spacer.

5. The connector apparatus of claim 1, wherein the spacer is generally cylindrically shaped, with a radially opening slot therein for receiving the connector.

6. The connector apparatus of claim 5, wherein the spacer includes a first and a second radially opening slot therein for receiving the connector, at opposite axial ends thereof and each opening toward a respective axial end of the spacer, to thereby allow the spacer to be installed in the bore with either the first or the second axial end thereof facing the retainer, and to thereby allow insertion of the connector into a desired one of the first or second radially extending slots, regardless of which of the first and second axial ends of the spacer is facing toward the retainer.

7. The connector apparatus of claim 5, wherein the connector includes locking tangs for engaging the radially opening slot in the spacer and retaining the connector in the slot.

8. The connector of claim 7, wherein the connector includes a generally planar shaped connector housing of electrically insulating material defining:

the locking tangs at one end of the connector housing;

a first and a second generally planar surface of the connector housing;

first and second contact receiving recesses in the first and second generally planar surfaces respectively, for receiving a first and a second ECO switch contact therein; and one or more retaining bridges adjacent each of the first and second recesses for retaining the first and second ECO switch contacts in the first and second recesses.

9. The connector apparatus of claim 8, wherein the connector further comprises:

a first and a second ECO switch contact disposed in the first and second recesses respectively of the connector housing, each having a wire attached to a distal end thereof at an end of the connector housing opposite the locking tangs and defining barbs for engaging the connector housing and retaining the first and second ECO switch contacts in the recesses; and a connector cover attached to the connector housing over the distal ends of the first and second ECO switch contacts.

10. A control apparatus for installation into a bore of a gas control valve of a gas appliance having an electrical cut-off (ECO) switch and a thermocople, where the bore of the gas control valve defines a central longitudinally extending axis thereof and the thermocouple includes an electrical terminal thereof, the control apparatus comprising:

an automatic pilot valve magnet, axially insertable into the bore and having a pilot valve magnet electrical terminal at an axial end thereof; and a connector apparatus for connecting the ECO switch of the gas appliance in a series electrical circuit relationship between the electrical terminal of the thermocouple and the electrical terminal of the automatic pilot valve magnet, when the pilot valve magnet is mounted in a bore of a gas control valve, the connector apparatus comprising a spacer, a connector and a retainer;

the spacer being adapted for installation into the bore between the pilot valve magnet and the thermocouple;

the connector being adapted for engaging the spacer, and having first and second axially spaced electrical contacts electrically insulated from one another, the first electrical contact being adapted for contacting the electrical terminal of the pilot valve magnet, and the second electrical contact being adapted for contacting the electrical terminal of the thermocouple; and the retainer having an external thread on an outer periphery thereof for threadably engaging the bore and clamping the spacer against the pilot valve magnet, the retainer also having an internally threaded, axially oriented, through-hole therein for threadably receiving and retaining the thermocouple therein with the electrical terminal of the thermocouple in contact with the second electrical contact of the connector.

11. The control apparatus of claim 10, wherein the retainer further comprises a cylindrically shaped annular insert of electrically insulative material disposed in the axially oriented through-hole at one end thereof, for providing a ring of electrical insulation between the electrical contact of the thermocouple and the retainer.

12. The control apparatus of claim 10, wherein:

the bore of the gas control valve defines a generally cylindrical wall thereof having a window extending radially therethrough for passage of the connector; and the connector is adapted for insertion in a radial direction, through the window and into engagement with the spacer.

13. The control apparatus of claim 10 wherein:

the bore of the gas control valve defines a generally cylindrical wall thereof having a window extending radially therethrough for passage of the connector;

the window defines an edge thereof; and the spacer includes one or more anti-rotation tabs extending radially outward therefrom for engaging the edge of the window, to thereby preclude rotation of the spacer in the bore as the retainer is threaded into contact with the spacer.

14. The control apparatus of claim 10, wherein the spacer is generally cylindrically shaped, with a radially opening slot therein for receiving the connector.

15. The control apparatus of claim 14, wherein the spacer includes a first and a second radially opening slot therein for receiving the connector, at opposite axial ends thereof and each opening toward a respective axial end of the spacer, to thereby allow the spacer to be installed in the bore with either the first or the second axial end thereof facing the retainer, and to thereby allow insertion of the connector into a desired one of the first or second radially extending slots, regardless of which of the first and second axial ends of the spacer is facing toward the retainer.

16. The control apparatus of claim 14, wherein the connector includes locking tangs for engaging the radially opening slot in the spacer and retaining the connector in the slot.

17. The control apparatus of claim 16, wherein the connector includes a generally planar shaped connector housing of electrically insulating material defining:

the locking tangs at one end of the connector housing;

a first and a second generally planar surface of the connector housing;

first and second contact receiving recesses in the first and second generally planar surfaces respectively, for receiving a first and a second ECO switch contact therein; and one or more retaining bridges adjacent each of the first and second recesses for retaining the first and second ECO switch contacts in the first and second recesses.

18. The control apparatus of claim 17, wherein the connector further comprises:

a first and a second ECO switch contact disposed in the first and second recesses respectively of the connector housing, each having a wire attached to a distal end thereof at an end of the connector housing opposite the locking tangs and defining barbs for engaging the connector housing and retaining the first and second ECO switch contacts in the recesses; and a connector cover attached to the connector housing over the distal ends of the first and second ECO switch contacts.

19. A gas control valve for an appliance having an electrical cut-off (ECO) switch and a thermocople, where the thermocouple includes an electrical terminal thereof, the gas control valve comprising:

a control valve housing having a bore therein, with the bore defining a central longitudinally extending axis thereof, an automatic pilot valve magnet, axially insertable into the bore and having a pilot valve magnet electrical terminal at an axial end thereof; and a connector apparatus for connecting the ECO switch of the gas appliance in a series electrical circuit relationship between the electrical terminal of the thermocouple and the electrical terminal of the automatic pilot valve magnet, when the pilot valve magnet is mounted in a bore of a gas control valve, the connector apparatus comprising a spacer, a connector and a retainer;

the spacer being adapted for installation into the bore between the pilot valve magnet and the thermocouple;

the connector being adapted for engaging the spacer, and having first and second axially spaced electrical contacts electrically insulated from one another, the first electrical contact being adapted for contacting the electrical terminal of the pilot valve magnet, and the second electrical contact being adapted for contacting the electrical terminal of the thermocouple; and the retainer having an external thread on an outer periphery thereof for threadably engaging the bore and clamping the spacer against the pilot valve magnet, the retainer also having an internally threaded, axially oriented, through-hole therein for threadably receiving and retaining the thermocouple therein with the electrical terminal of the thermocouple in contact with the second electrical contact of the connector.

20. The gas control valve of claim 19 wherein the retainer further comprises a cylindrically shaped annular insert of electrically insulative material disposed in the axially oriented through-hole at one end thereof, for providing a ring of electrical insulation between the electrical contact of the thermocouple and the retainer.

21. The gas control valve of claim 19, wherein:

the bore of the gas control valve defines a generally cylindrical wall thereof having a window extending radially therethrough for passage of the connector; and the connector is adapted for insertion in a radial direction, through the window and into engagement with the spacer.

22. The gas control valve of claim 19, wherein:

the bore of the gas control valve defines a generally cylindrical wall thereof having a window extending radially therethrough for passage of the connector;

the window defines an edge thereof; and the spacer includes one or more anti-rotation tabs extending radially outward therefrom for engaging the edge of the window, to thereby preclude rotation of the spacer in the bore as the retainer is threaded into contact with the spacer.

23. The control valve of claim 19, wherein:

the spacer is generally cylindrically shaped, with a radially opening slot therein for receiving the connector; and the connector includes locking tangs for engaging the radially opening slot in the spacer and retaining the connector in the slot.

24. The control valve of claim 19, wherein the connector comprises:

a connector housing, a first and a second ECO switch contact each having a wire attached thereto at a distal end thereof, and a connector cover;

the connector housing being generally planar shaped, formed of an electrically insulating material, and defining the locking tangs at one end thereof, a first and a second generally planar surface thereof, first and second contact receiving recesses in the first and second generally planar surfaces respectively, and one or more retaining bridges adjacent each of the first and second recesses for retaining the first and second ECO switch contacts in the first and second recesses;

the first and second ECO switch contacts being disposed in the first and second contact receiving recesses respectively of the connector housing, with the distal ends thereof disposed at an end of the connector housing opposite the locking tangs;

the first and second ECO switch contacts also each defining barbs for engaging the connector housing and retaining the first and second ECO switch contacts in the contact receiving recesses; and the connector cover being attached to the connector housing over the distal ends of the first and second ECO switch contacts.

* * * * *